US006342858B1

(12) United States Patent
Dakeya et al.

(10) Patent No.: US 6,342,858 B1
(45) Date of Patent: Jan. 29, 2002

(54) PORTABLE TERMINAL DEVICE WITH CHIP ANTENNA

(75) Inventors: Yujiro Dakeya, Omihachiman; Harufumi Mandai, Takatsuki; Kunihiro Watanabe, Shiga-ken; Teruhisa Tsuru, Kameoka, all of (JP)

(73) Assignee: Murata Manufacturing Co. Ltd. (JP)

( * ) Notice: Subject to any disclaimer, the term of this patent is extended or adjusted under 35 U.S.C. 154(b) by 0 days.

(21) Appl. No.: 09/575,424

(22) Filed: May 22, 2000

(30) Foreign Application Priority Data

Jun. 29, 1999 (JP) ..... 11-183119

(51) Int. Cl.[7] ..... H01Q 1/24
(52) U.S. Cl. ..... 343/702; 343/873; 343/895
(58) Field of Search ..... 343/702, 700 MS, 343/895, 846, 848, 873; 455/89, 90

(56) References Cited

U.S. PATENT DOCUMENTS

| | | | | |
|---|---|---|---|---|
| 5,909,198 A | * | 6/1999 | Mandai et al. | 343/895 |
| 6,181,284 B1 | * | 6/1999 | Madsen et al. | 343/702 |
| 5,943,021 A | * | 8/1999 | Hayes et al. | 343/702 |
| 5,966,098 A | * | 10/1999 | Qi et al. | 343/702 |
| 5,995,052 A | * | 11/1999 | Sadler et al. | 343/702 |

FOREIGN PATENT DOCUMENTS

| | | |
|---|---|---|
| EP | 0790662 | 2/1997 |
| EP | 0762536 | 3/1997 |
| EP | 0825669 | 2/1998 |
| WO | WO 9744946 | 11/1997 |

OTHER PUBLICATIONS

IBM Technical Disclosure Bulletin—"Antenna Array and Housing For Notebook Computers" vol. 39, n. 1, Jan. 1996 pp. 313–314.

* cited by examiner

*Primary Examiner*—Tan Ho
(74) *Attorney, Agent, or Firm*—Ostrolenk, Faber, Gerb & Soffen, LLP

(57) ABSTRACT

A portable terminal device including a main body including a data entry keyboard; a cover openably and closably attached to the main body and establishing a connecting portion between the main body and the cover; a display disposed on the inner side of the cover; a chip antenna disposed on the cover at a place other than the display and opposed to the connecting portion; the chip antenna including a ceramic base body, a conductor disposed at least either inside the base body or on a surface thereof, and a feeding terminal disposed on a surface of the base body and connected to one end of the conductor. The above portable terminal device has the directivity of an antenna in a desired direction without increasing the size and weight of the portable terminal device and without having a bulky and/or separate and/or protruding antenna device.

5 Claims, 6 Drawing Sheets

PORTABLE TERMINAL DEVICE WITH CHIP ANTENNA

BACKGROUND OF THE INVENTION

1. Field of the Invention

The present invention relates to portable terminal devices, and more specifically, the invention relates to portable terminal devices such as note-type personal computers and electronic pocketbooks used as the nodes of wireless LAN systems, in which the covers of the devices are opened when used.

2. Description of the Related Art

Local Area Networks (LANs) have a structure in which the system is located in specified areas, for example, on the sites or premises of users in such a manner that communications are performed by mutually connecting various individual devices such as personal computers, servers, facsimiles, and the like. This system is used for various purposes such as gaining access to the database of servers via personal computers or gaining access to devices of other LAN systems via a communication network connected to the LAN system.

The connections between devices in LAN systems are very often made by wire communication channels. However, there are wireless LAN systems in which parts of the connections are make by wireless communication channels. In the wireless LAN systems, it is not necessary to mechanically connect individual devices to the LAN communication networks. Alternatively, the wireless LAN system can be used by registration, regardless of locations, as long as the devices are located in areas to which wireless radio waves can reach. Accordingly, this is a significantly useful system.

FIGS. 8A and 8B show the front view of a prior art portable terminal device and the side view thereof, respectively. A portable terminal device 50 has a main body 52 including a data entry keyboard 51 and the like, a cover 53 openably and closably attached to the main body 52, a liquid crystal display 54 disposed on the inner side of the cover 53, and a monopole antenna 55 for a wireless LAN system. In addition, a board having a ground, on which a calculation processing unit, a memory unit, and the like are mounted, is disposed inside the main body 52, although the board is not shown in the figure. When the portable terminal device 50 is used, the cover 53 attached to the main body 52 is opened and the monopole antenna 55 is set up. When carried with a user, the cover 53 is closed in such a manner that the cover 53 and the main body 52 are put together, and the monopole antenna 55 is collapsed along the main body 53.

Since a beam 56 in a horizontal direction can be obtained by the monopole antenna 55 in the above portable terminal device 50, the monopole antenna 55 can sufficiently satisfy requirements as the directional characteristics of an antenna. Meanwhile, when carried with a user, the monopole antenna 55 is collapsed and the portable terminal device 50 is placed in a bag, or a pocket. As a result, since the monopole antenna 55 collapsed alongside of the main body 52 exists as a protruding item, the antenna is a nuisance to the user, and it also tends to be easily broken. To solve these problems, another prior art portable terminal device has been developed as shown in FIGS. 9A and 9B.

FIGS. 9A and 9B show the front view of another prior art portable terminal device and the side view thereof, respectively. When compared with the portable terminal device 50 (shown in FIGS. 8A and 8B), in a portable terminal device 60, instead of disposing a monopole antenna, a wireless card 62 having a monopole antenna 61 is connected to a PCMCIA slot (not shown) of the main body 52, by which a wireless communication function is given to the portable terminal device 60.

In each of the above conventional portable terminal devices, however, since the portable terminal device and the wireless card are separated, there is a problem in that it is inconvenient for a user to carry such a type of portable terminal device with him.

In addition, since the wireless card is directly connected to the main body having the ground, there is a problem in that the directivity of the monopole antenna toward the main body side deteriorates significantly. Furthermore, there is a problem in that the directivity of the monopole antenna is influenced by digital noise from the main body.

SUMMARY OF THE INVENTION

To overcome the above described problems, preferred embodiments of the present invention provide a portable terminal device having the directivity of an antenna in a desired direction without increasing the size and weight of the portable terminal device.

One preferred embodiment of the present invention provides a portable terminal device comprising: a main body including a data entry keyboard; a cover openably and closably attached to the main body and establishing a connecting portion between the main body and the cover; a display disposed on the inner side of the cover; a chip antenna disposed on the cover at a place other than the display and opposed to the connecting portion; and the chip antenna comprising a ceramic base body, a conductor disposed at least either inside the base body or on a surface thereof, and a feeding terminal disposed on a surface of the base body and connected to one end of the conductor.

According to the above described structure and arrangement, the chip antenna is disposed on the cover at a place other than the display and opposed to the connecting portion. When the cover is opened to use the portable terminal device, the chip antenna is thereby positioned as far as possible from the main body having a ground. As a result, the gain of the chip antenna can be substantially uniform in the range of 360°. Therefore, a wireless communication channel in which a portable terminal device is stabilized in the range of 360° can be provided.

In addition, since the chip antenna includes the ceramic base body and the conductor formed at least either inside the base body or a surface thereof, the chip antenna can be miniaturized by a wavelength-shortening effect. As a result, the cover of the portable terminal device and the chip antenna can be integrated by disposing the antenna on the inner side of the cover of the portable terminal device. Accordingly, this arrangement contributes to miniaturization of the portable terminal device and weight reduction thereof.

Other features and advantages of the present invention will become apparent from the following description of the invention which refers to the accompanying drawings.

BRIEF DESCRIPTION OF THE DRAWING(S)

Figure 1A:
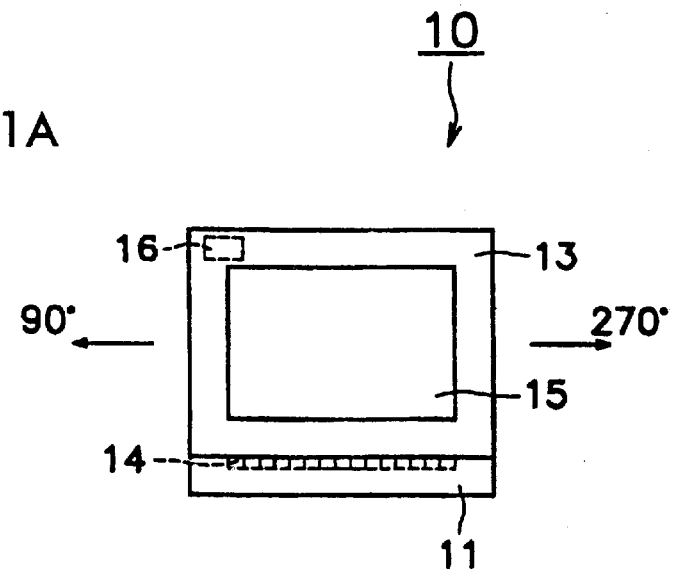
FIG. 1A is a partial perspective front view of a portable terminal device according to an embodiment of the present invention.
Figure 1B:
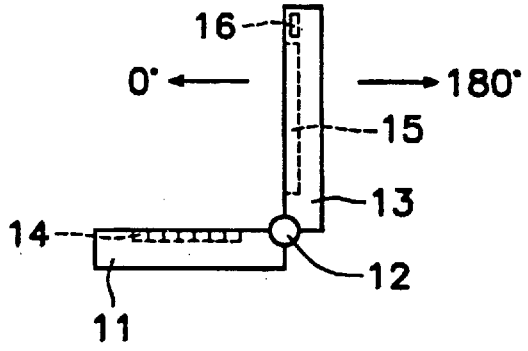
FIG. 1B is a partial perspective side view thereof.
Figure 2:
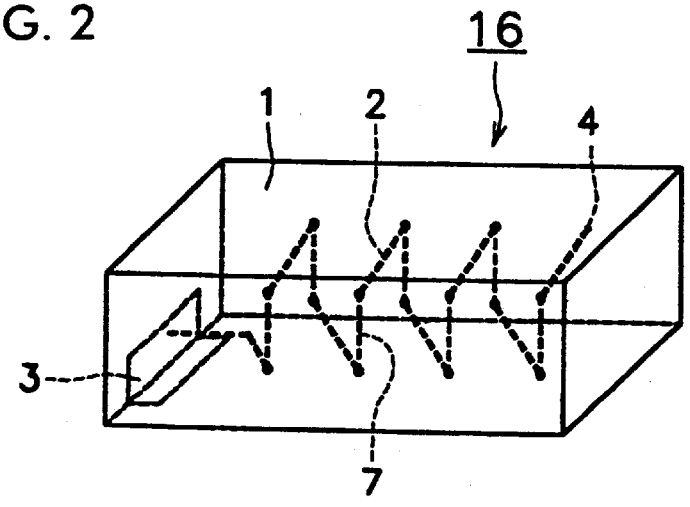
FIG. 2 is a perspective view of a chip antenna used in the portable terminal device shown in FIG. 1.
Figure 7A:
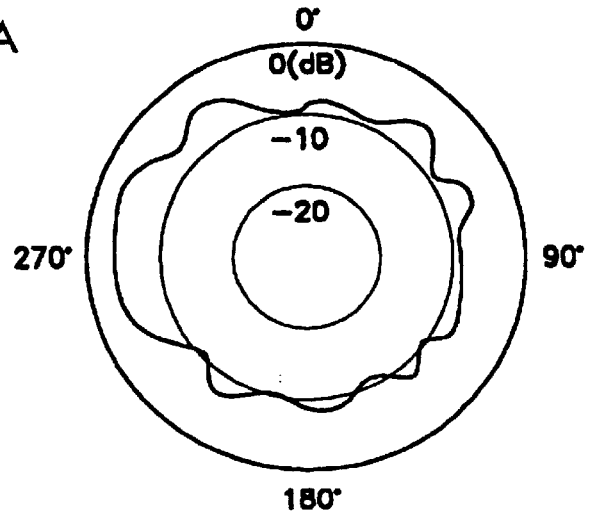
Figure 7B:
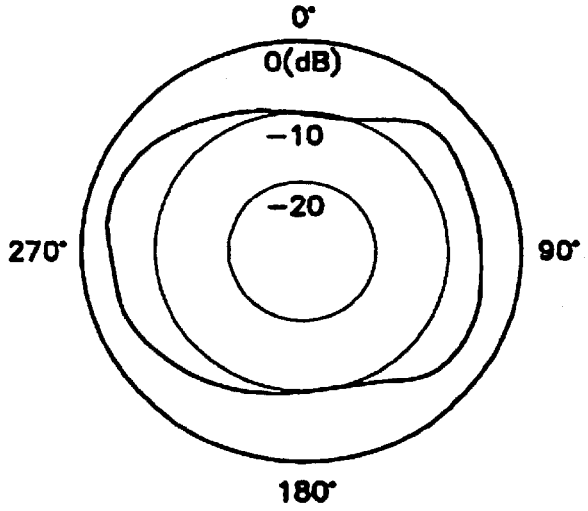
Figure 7C:
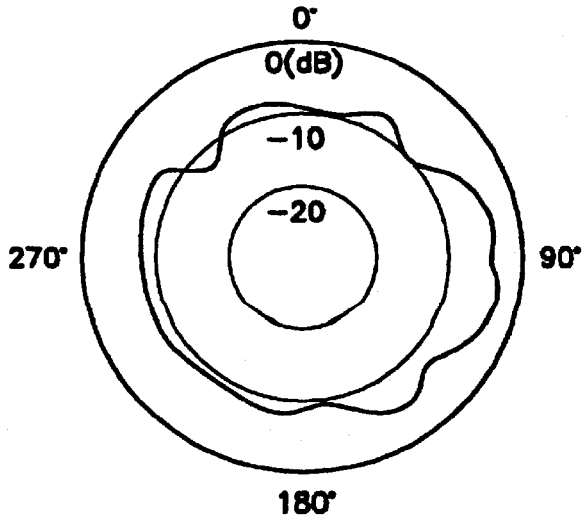

FIG. 7A is a view of the directivity of the chip antenna shown in FIG. 2 obtained when the chip antenna is positioned at the left edge on the cover of the portable terminal device shown in FIGS. 1A and 1B; FIG. 7B is a view thereof obtained when the chip antenna is positioned substantially at the center thereon; and FIG. 7C is a view thereof obtained when the chip antenna is positioned at the right edge thereon.

Figure 8A:
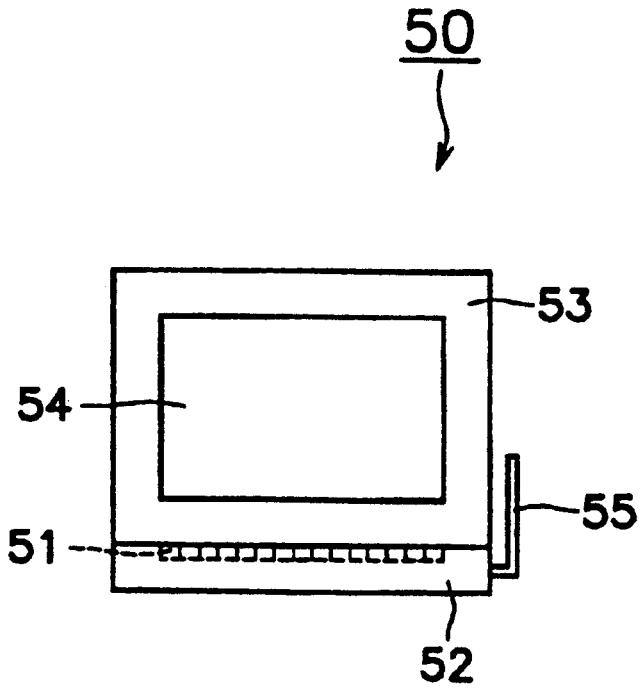
FIG. 8A PRIOR ART
Figure 8B:
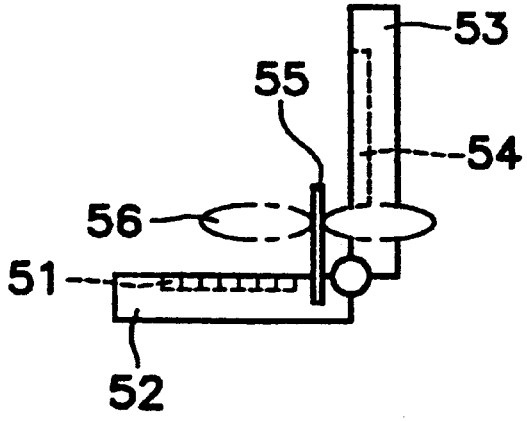
FIG. 8B PRIOR ART

FIG. 8A is a front view of a conventional portable terminal device; and FIG. 8B is a side view thereof.

Figure 9A:
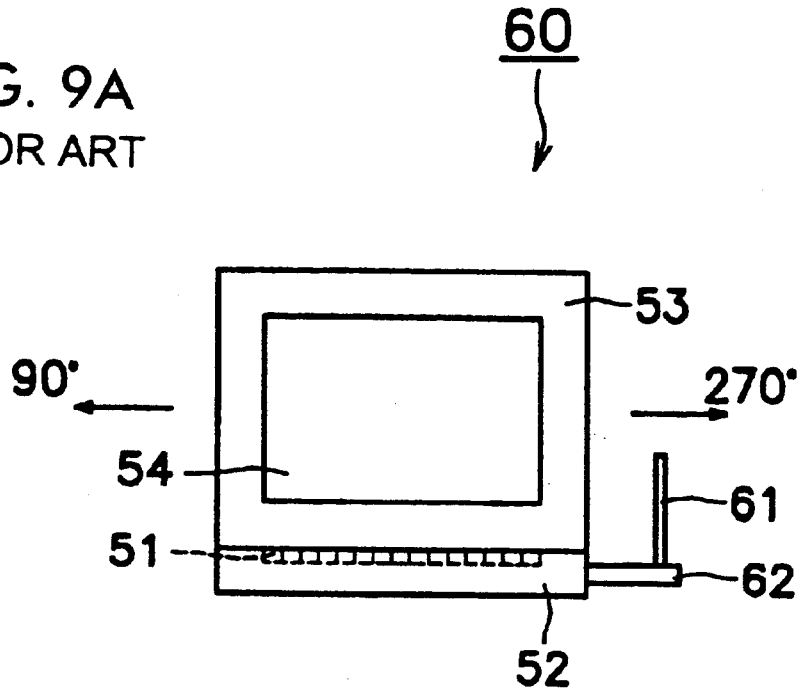
FIG. 9A PRIOR ART
Figure 9B:
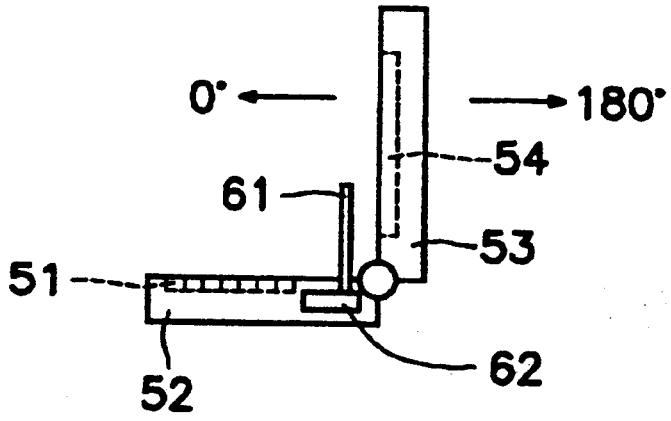
FIG. 9B PRIOR ART

FIG. 9A is a front view of another conventional portable terminal device, and FIG. 9B is a side view thereof.

DETAILED DESCRIPTION OF EMBODIMENTS OF THE INVENTION

FIG. 1A is a partial perspective front view of a portable terminal device according to an embodiment of the present invention, and FIG. 1B is a partial perspective side view thereof. A portable terminal device 10 has a main body 11, and a cover 13 openably and closably attached to the main body 11 by a hinge 12.

A data entry keyboard 14 is disposed on the upper surface of the main body 11. The cover 13 attached to the main body 11 by the hinge 12 is retained at a position in which the cover 13 is closed to be put together with the main body 11 and at a position in which the cover 13 is stood up substantially vertically to the main body 11. A display 15 is disposed on the inner side of the cover 13, that is, at a position opposing the data entry keyboard 13 of the main body 11 when the cover 13 is closed. The display 15 is formed by a liquid crystal display or the like, and necessary information is displayed on the display 15. In addition, data is inputted by the data entry keyboard 14 on the main body 11.

A chip antenna 16 is disposed at a place other than the display 15 on the inner upper part of the cover 13, e.g., as shown at the upper left, and is connected to a transmission/reception circuit disposed inside the main body 11, although this is not shown in the figure.

FIG. 2 is a perspective view of a chip antenna used in the portable terminal device shown in FIGS. 1A and 1B. The chip antenna 16 has a rectangular-parallelopiped base body 1, a conductor 2 formed inside the base body 1, and a feeding terminal 3 formed on a surface of the base body 1. The chip antenna 16 has, for example, dimensions of 9.5×2×2 (mm).

The conductor 2 is disposed in a spiral manner in the longitudinal direction of the base body 1. In addition, one end of the conductor 2 is extended onto an end face of the base body 1 to be connected to the feeding terminal 3, and the other end thereof forms a free end 4 inside the base body 1.

Figure 3:
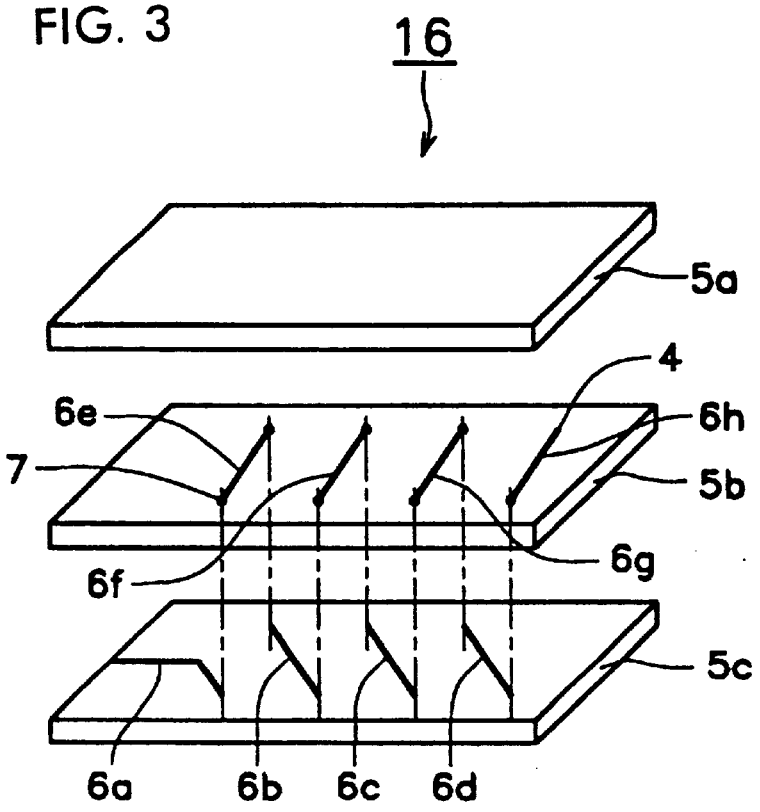
FIG. 3 is an exploded perspective view of the chip antenna shown in FIG. 2.

FIG. 3 is an exploded perspective view of the chip antenna shown in FIG. 2. The base body 1 is comprised of laminated rectangular dielectric-ceramic sheet layers 5*a* to 5*c*. The main components of the dielectric ceramic material are barium oxide, aluminum oxide, and silica. On the surfaces of the sheet layers 5*b* and 5*c*, conductive patterns 6*a* to 6*h* are disposed by printing, evaporation, bonding together, or plating. These conductive patterns are preferably formed of copper or an alloy of copper, and they have substantially L-letter forms or substantially straight-line forms.

Via-hole conductors 7 are formed at specified positions on the sheet layer 5*b* (at both ends of the conductive patterns 6*e* to 6*g*, and at an end of a conductive pattern 6*h*) in the thickness direction.

In addition, the laminated sheet layers 5*a* to 5*c* are fired, and the conductive patterns 6*a* to 6*h* are connected by the via-hole conductors 7. This arrangement permits the conductor 2 wound in a spiral form in the longitudinal direction of the base body 1 to be formed inside the base body 1. Antennas of this general type are known from various U.S. patents assigned to the assignee. This application, e.g., U.S. Pat. No. 5,767,811.

Figure 4:
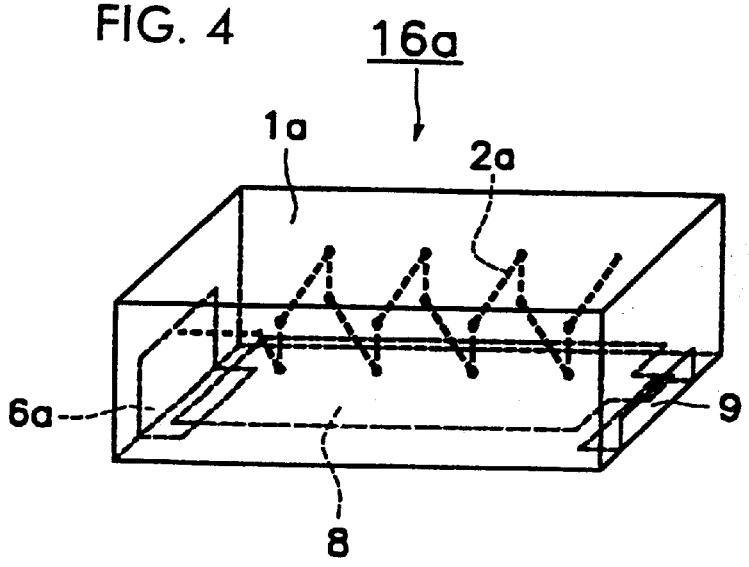
FIG. 4 is a perspective view of a modified example of the chip antenna shown in FIG. 2.

FIG. 4 is a perspective view of a modified example of the chip antenna shown in FIG. 2. A chip antenna 16*a* shown in FIG. 4 has a rectangular-parallelopiped base body 1*a*, a conductor 2*a* wound in a spiral form in the longitudinal direction of the base body 1*a* inside the base body 1*a*, a ground electrode 8 opposing the conductor 2*a*, a feeding terminal 6*a* for applying voltage to the conductor 2*a* on a surface of the base body 1*a*, and a ground terminal 9 thereon, the ground terminal 9 being connected to the ground electrode 8.

Figure 5:
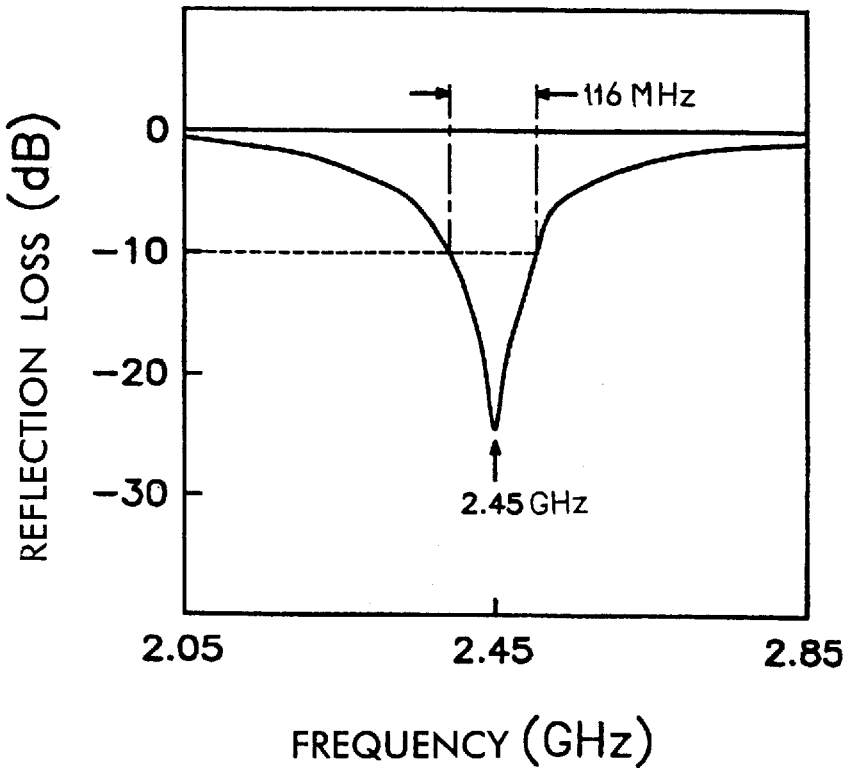
FIG. 5 is a graph of reflection characteristics of the chip antenna shown in FIG. 2 obtained when the chip antenna is mounted on the portable terminal device shown in FIG. 1.

FIG. 5 is a graph of the reflection characteristics of the chip antenna shown in FIG. 2, obtained when the chip antenna is mounted on the portable terminal device shown in FIGS. 1A and 1B. In this figure, it is found that even when the chip antenna 16 is mounted on the portable terminal device 10, the chip antenna 16 provides a resonant frequency of 2.45 (GHz) and a bandwidth of 116 (MHz).

Figure 6:
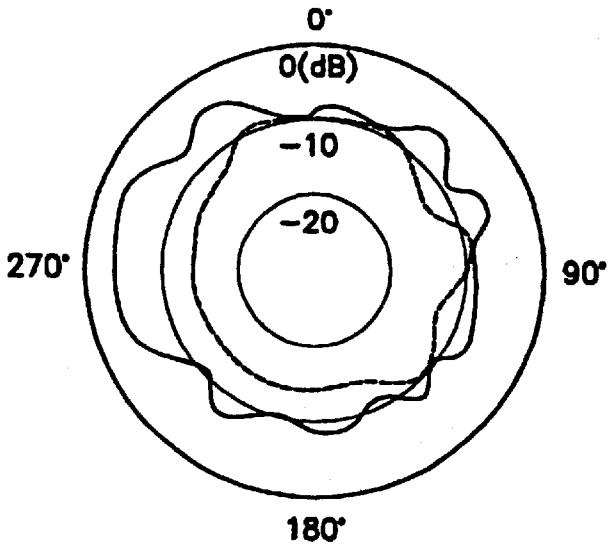
FIG. 6 is a chart illustrating the directivity of the chip antenna shown in FIG. 2 obtained when the chip antenna is mounted on the portable terminal device shown in FIG. 1.

FIG. 6 is a chart illustrating the directivity of the chip antenna shown in FIG. 2 obtained when the chip antenna is mounted on the portable terminal device shown in FIGS. 1A and 1B. A solid line indicates a case of the portable terminal device 10 of the embodiment (shown in FIGS. 1A and 1B) , and a broken line indicates a case of the conventional portable terminal device 60 (shown in FIG. 9). In this figure, the range of 0° to 360° is equivalent to the range of 0° to 360° each shown in FIGS. 1A, 1B and 9.

This figure shows that although the chip antenna used in the portable terminal device 10 of the embodiment of the invention exhibits a substantially constant gain in the range of 360°, the chip antenna of the conventional portable terminal device 50 shows deterioration of the gain in a 90° direction where the main body 52 exists.

FIG. 7A is a view of the directivity of the chip antenna shown in FIG. 2 obtained when the chip antenna is positioned at the left edge on the cover of the portable terminal device shown in FIGS. 1A and 1B, FIG. 7B is a view thereof obtained when the chip antenna is positioned substantially at the center thereon, and FIG. 7C is a view thereof obtained when the chip antenna is positioned at the right edge thereon. In these figures, it is found that the chip antenna 16 exhibits a substantially constant gain in the range of 360°, regardless of the positions of the chip antenna 16 shown in FIG. 2 on the cover 13.

Although the description has been given of a portable terminal device of the above embodiment whose chip antenna is embedded in the inner side of the cover, the invention is applicable as long as the chip antenna is disposed on the cover. Thus, the chip antenna may be exposed on the inner side of the cover or the outer side thereof.

In addition, regarding antenna characteristics, the case of the chip antenna shown in FIG. 2 mounted on the portable terminal device has been described. However, the same antenna characteristics can also be obtained by the chip antenna shown in FIG. 4 mounted thereon.

Furthermore, although the case of the chip-antenna conductor 2, 2*a* disposed inside the base body 1, 1*a* has been described, the chip-antenna conductor 2, 2*a* may be disposed on a surface of the base body 1, 1*a*.

While the invention has been particularly shown and described with reference to preferred embodiments thereof, it will be understood by those skilled in the art that the forgoing and other changes in form and details may be made therein without departing from the spirit of the invention.

What is claimed is:

1. A portable terminal device comprising:

a main body including a data entry keyboard and the main body further having a ground;

a cover openably and closably attached to the main body and establishing a connecting portion between the main body and the cover;

a display disposed on the inner side of the cover;

a chip antenna disposed on the cover at a place other than the display and opposed to the connecting portion; and the chip antenna comprising a ceramic base body, a conductor disposed at least either inside the base body or on a surface thereof, and a feeding terminal disposed on a surface of the base body and connected to one end of the conductor, whereby, when the cover is opened, the chip antenna is disposed away from the ground.

2. The portable terminal device of claim 1, wherein the chip antenna is disposed inside the cover.

3. The portable terminal device of claim 1, wherein the chip antenna is disposed on the cover outside the cover.

4. The portable terminal device of claim 1, wherein the chip antenna comprises a ground electrode and a ground terminal connected to the ground electrode.

5. The portable terminal device of claim 1, wherein the chip antenna comprises a monopole antenna.

* * * * *